US010858866B2

(12) United States Patent
Madrid et al.

(10) Patent No.: US 10,858,866 B2
(45) Date of Patent: Dec. 8, 2020

(54) HOUSING FOR A LATCH WITH WATER DRAIN OPENING AND METHOD OF DRAINING WATER FROM A LATCH

(71) Applicant: Inteva Products, LLC, Troy, MI (US)

(72) Inventors: Jose Manuel Madrid, Chihuahua (MX); Francisco Javier Guevara, Chihuahua (MX); Manuel Escamilla, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 864 days.

(21) Appl. No.: 15/165,354

(22) Filed: May 26, 2016

(65) Prior Publication Data

US 2016/0348407 A1 Dec. 1, 2016

Related U.S. Application Data

(60) Provisional application No. 62/166,425, filed on May 26, 2015.

(51) Int. Cl.

| | |
|---|---|
| ***E05B 77/34*** | (2014.01) |
| ***E05B 85/02*** | (2014.01) |
| ***E05B 77/44*** | (2014.01) |

(52) U.S. Cl.

CPC ..... *E05B 77/34* (2013.01); *E05B 77/44* (2013.01); *E05B 85/02* (2013.01)

(58) Field of Classification Search

CPC ..... E05B 85/02; E05B 77/34; E05B 15/1635; E05B 2015/1664; Y10T 292/62

See application file for complete search history.

(56) References Cited

U.S. PATENT DOCUMENTS

| | | | | |
|---|---|---|---|---|
| 3,969,789 | A | 7/1976 | Wize | |
| 5,169,186 | A * | 12/1992 | Fukumoto | E05B 77/34 292/201 |
| 5,678,869 | A * | 10/1997 | Yoshikuwa | E05B 81/66 292/216 |
| 6,375,234 | B1 * | 4/2002 | Brackmann | E05B 77/34 292/1 |
| 6,568,741 | B1 | 5/2003 | Leung et al. | |
| 6,679,531 | B2 | 1/2004 | Rogers, Jr. et al. | |
| 7,637,542 | B2 | 12/2009 | Suzumura et al. | |
| 8,348,310 | B2 | 1/2013 | Vazquez et al. | |

(Continued)

FOREIGN PATENT DOCUMENTS

| | | | |
|---|---|---|---|
| CN | 102199962 | A | 9/2011 |
| CN | 202997173 | U | 6/2013 |

(Continued)

OTHER PUBLICATIONS

CN Office Action for Application No. 201610353036.7; dated Jan. 2, 2019.

(Continued)

*Primary Examiner* — Mark A Williams

(74) *Attorney, Agent, or Firm* — Cantor Colburn LLP

(57) ABSTRACT

A housing for a vehicle latch is provided. The housing having a fluid pathway extending from an interior of the housing to an exterior of the housing through a perimeter wall, wherein the fluid pathway is defined by an inclined surface that extends downwardly and away from an interior of the housing to an exterior of the housing.

20 Claims, 17 Drawing Sheets

Iso - Front view

(56) References Cited

U.S. PATENT DOCUMENTS

| | | | | |
|---|---|---|---|---|
| 2004/0262927 | A1* | 12/2004 | Fukunaga | E05B 77/34 292/216 |
| 2005/0140148 | A1* | 6/2005 | Stoof | E05B 17/04 292/216 |
| 2010/0127512 | A1 | 5/2010 | Vazquez et al. | |
| 2011/0204659 | A1 | 8/2011 | Estrada et al. | |
| 2012/0292927 | A1 | 11/2012 | Vazquez et al. | |
| 2016/0348407 | A1 | 12/2016 | Madrid et al. | |

FOREIGN PATENT DOCUMENTS

| | | | |
|---|---|---|---|
| CN | 203499347 | U | 3/2014 |
| CN | 104347296 | A | 2/2015 |
| CN | 20578044 | U | 12/2016 |
| DE | 102014102538 | A1 | 5/2015 |

OTHER PUBLICATIONS

English Translation to CN Office Action for Application No. 201610353036.7; dated Jan. 2, 2019.
CN Office Action for Application No. 201610353036.7.
English Machine Translation to Abstract CN104347296.
English Machine Translation to Abstract CN202997173.
English Machine Translation to Abstract CN203499347.
English Machine Translation to Abstract DE102014102538.
English Translation to CN Office Action for Application No. 201610353036.7.
Search Report for Application No. 201610353036.7.
CN Office Action for Application No. 201610353036.7; dated Jul. 12, 2019.
English Translation to CN Office Action for Application No. 201610353036.7; dated Jul. 12, 2019.
Decision on Rejection for Application 201610353036.7; dated Jan. 21, 2020.
English Translation of Decision on Rejection for Application 201610353036.7; dated Jan. 21, 2020.
CN Office Action for Application No. 201610353036.7; dated Aug. 17, 2020.
English Translation to CN Office Action for Application No. 201610353036.7; dated Aug. 17, 2020.
Search Report for Application No. 201610353036.7; dated Aug. 7, 2020.

* cited by examiner

Iso - Front view

Iso - Front view

Iso - Front view

Back view

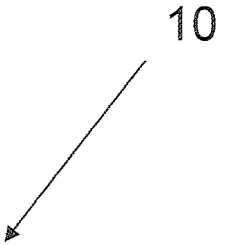
FIG. 5B
Back view
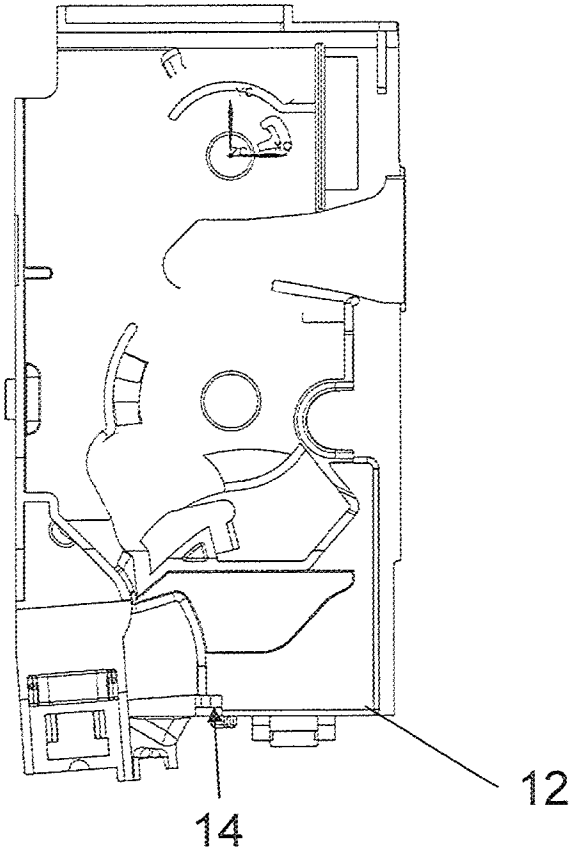

Iso - Back view

Iso - Back view

Iso - Back view

Iso - Back view

Iso - Front view

Iso - Front view

HOUSING FOR A LATCH WITH WATER DRAIN OPENING AND METHOD OF DRAINING WATER FROM A LATCH

CROSS REFERENCE TO RELATED APPLICATIONS

This application claims the benefit of U.S. Provisional Patent Application Ser. No. 62/166,425 filed on May 26, 2015, the entire contents of which are incorporated herein by reference thereto.

BACKGROUND

Most vehicles have a door latch assembly that is configured to keep the vehicle door closed and locked while also providing a means for opening or unlocking the door. In some applications, the door latch assembly includes an actuator having a motor for manipulating the state of the latch between locked and unlocked and/or opened and closed. In addition, electrical components may also be provided that generate signals indicative of the state of the latch. These signals may be provided by sensors or switches that are typically exposed to various environmental conditions and the historical performance of such systems have exhibited a distinct need to function flawlessly in wet environments. Alternatively, the latch and its associated actuator can be sealed from the environment. However, this adds cost and complexity to the latch assembly.

For example, some door latch actuators may be designed to be fully sealed units to prevent water ingress, which is very difficult to achieve practically and cost effectively. Here, the plastic actuator cases are either laser welded (or ultrasonic welded) or screwed/clipped together with a seal gasket between the mating halves of the cases. These sealing methods require high levels of accuracy especially for the molded components and expensive manufacturing methods and controls. Alternatively and if a drain opening is provided in the latch housing by providing an opening or window into the interior of the housing, the opening or window may not provide a suitable path for egress of fluids from the housing.

Accordingly it is desirable to provide a housing in which the high costs of component accuracy and complex manufacturing controls are eliminated and a means for water egress is provided.

SUMMARY OF THE INVENTION

In one non-limiting embodiment, a housing for a vehicle latch is provided. The housing having a fluid pathway extending from an interior of the housing to an exterior of the housing through a perimeter wall, wherein the fluid pathway is defined by an inclined surface that extends downwardly and away from an interior of the housing to an exterior of the housing.

In another non-limiting embodiment, a vehicle latch is provided. The vehicle latch having: a housing; a fluid pathway extending from an interior of the housing to an exterior of the housing through a perimeter wall of the housing, wherein the fluid pathway is defined by an inclined surface that extends downwardly and away from an interior of the housing to an exterior of the housing when the latch is in an installed configuration.

In yet another embodiment, a method of draining fluids from an interior of a vehicle latch is provided. The method including the steps of: locating a fluid pathway in a housing of the vehicle latch, wherein the fluid pathway extends from an interior of the housing to an exterior of the housing through a perimeter wall of the housing, wherein the fluid pathway is defined by an inclined surface that extends downwardly and away from an interior of the housing to an exterior of the housing when the latch is in an installed configuration.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

FIG. 5B is a back view of the housing of FIGS. 1 and 2 with a drain opening in accordance with an embodiment of the present invention;

DETAILED DESCRIPTION

As mentioned above, it is desirable to seal the housings of door latches and door latch actuators to prevent water ingress. However, this is difficult to achieve practically and cost effectively.

Referring now to the FIGS. and in accordance with an embodiment of the present invention a latch housing is configured to have a water drain or fluid passageway extending therethrough that will enable the latch assembly to shed water and drain it away from critical areas within the latch or latch assembly, rather than attempt to design them to be completely sealed units.

By incorporating such a water drain or fluid passageway in the housing, the requirement for the molded parts (actuator housing and cover) to have very tight tolerances in their mating areas can be eliminated.

Reference is made to the following U.S. Pat. Nos. 3,969,789; 6,568,741; 6,679,531; 8,348,310 and U.S. Patent Publication Nos. US 2010/0127512; US 2011/0204659; US 2012/0292927 and US 2014/0292000, the entire contents each of which are incorporated herein by reference thereto.

Referring now to the FIGS., various embodiments of the invention will be described with reference to specific embodiments, without limiting same, the attached FIGS. shows portions of a latch or latch assembly 10. In one embodiment, latch or latch assembly 10 may be contemplated for use with a vehicle door latch. However, the housing 10 is applicable to any environment where the features of various embodiments of the invention are desired. For example, the latch assembly or latch can be attached to a vehicle structure such that the fork bolt is moved between the open position and the closed position when a hood, door, window, lift gate, etc. is opened and closed and the fork bolt engages a striker that is attached to the hood, door, window, lift gate, etc.

Alternatively, the latch or latch assembly 10 may be secured to the hood, door, window, lift gate, etc. and the striker is secured to the vehicle body at an opening into which the hood, door, window, lift gate, etc. is received.

Therefore, the latch or latch assembly 10 may be located on a first element or first vehicle component which is either a frame (e.g., body member surrounding or proximate to an opening the movable member covers) or a movable member (e.g., door, window, lift gate, hood, etc.) of the vehicle.

Figure 1:
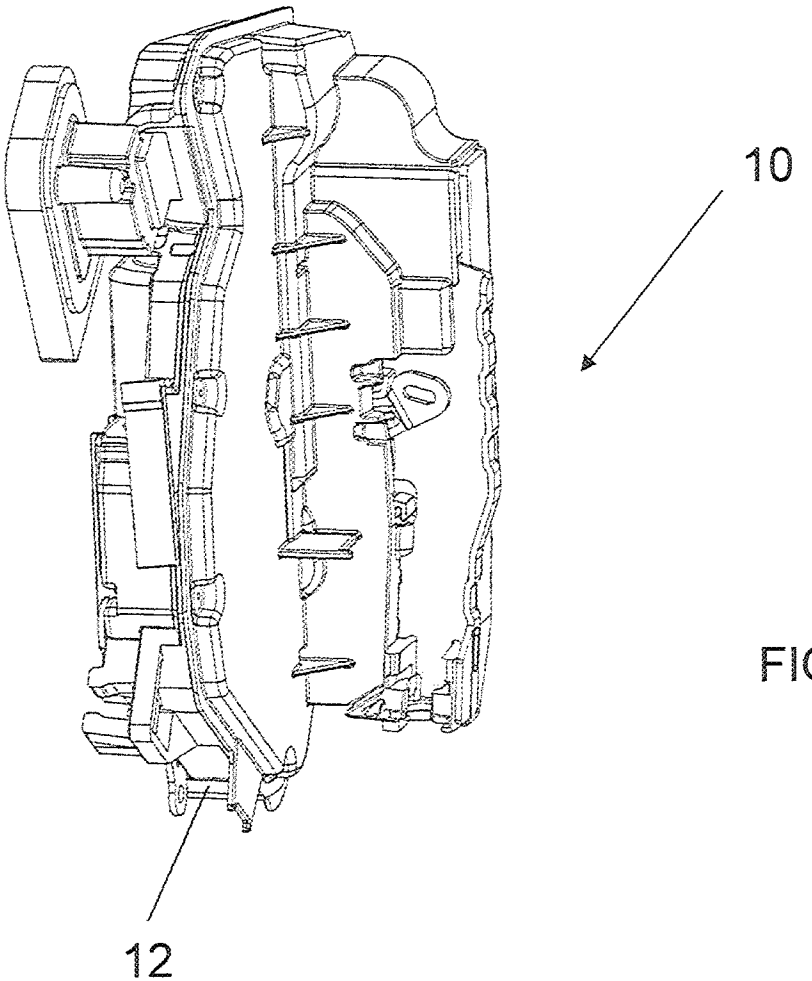
FIG. 1 is a perspective front view of a latch assembly without a drain opening in accordance with an embodiment of the present invention.
Figure 2:
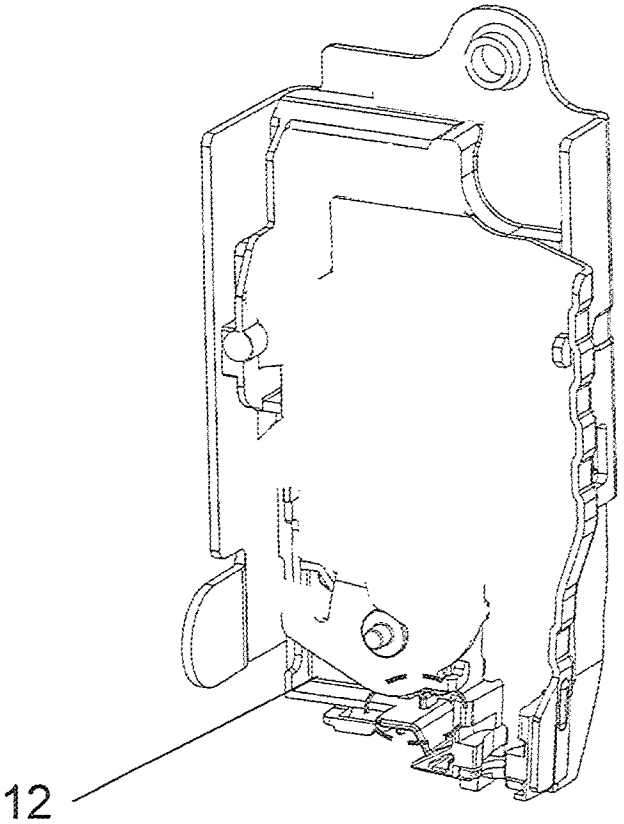
FIG. 2 is a perspective front view of the latch assembly of FIG. 1 with a portion of the latch assembly removed.
Figure 3:
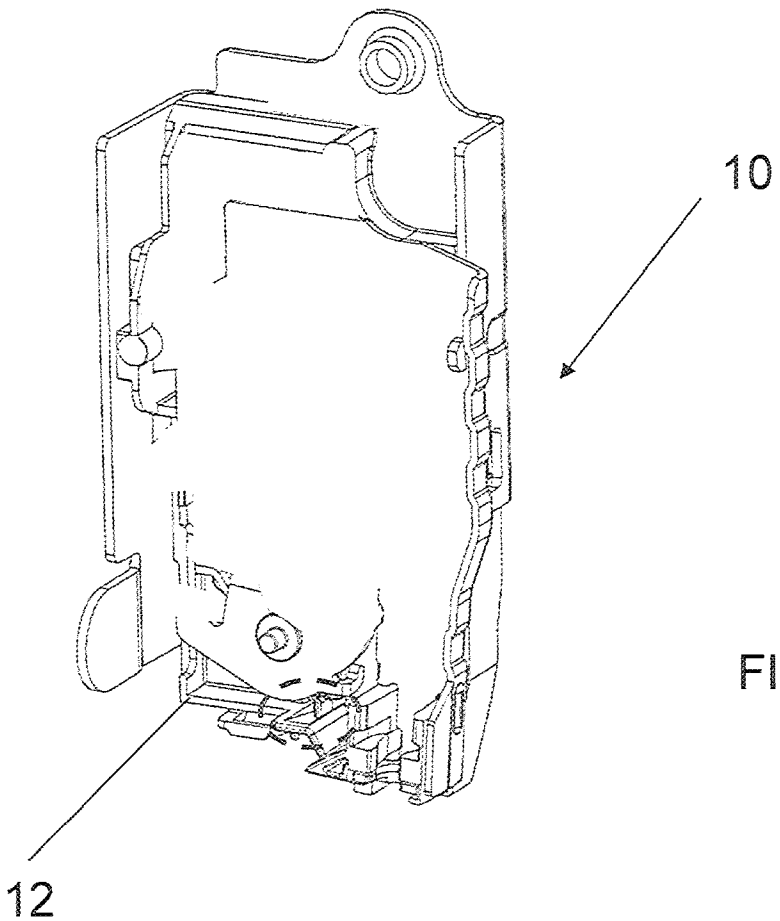
FIG. 3 is a perspective front view of the housing of the latch assembly illustrating a drain opening in accordance with an embodiment of the present invention.
Figure 4A:
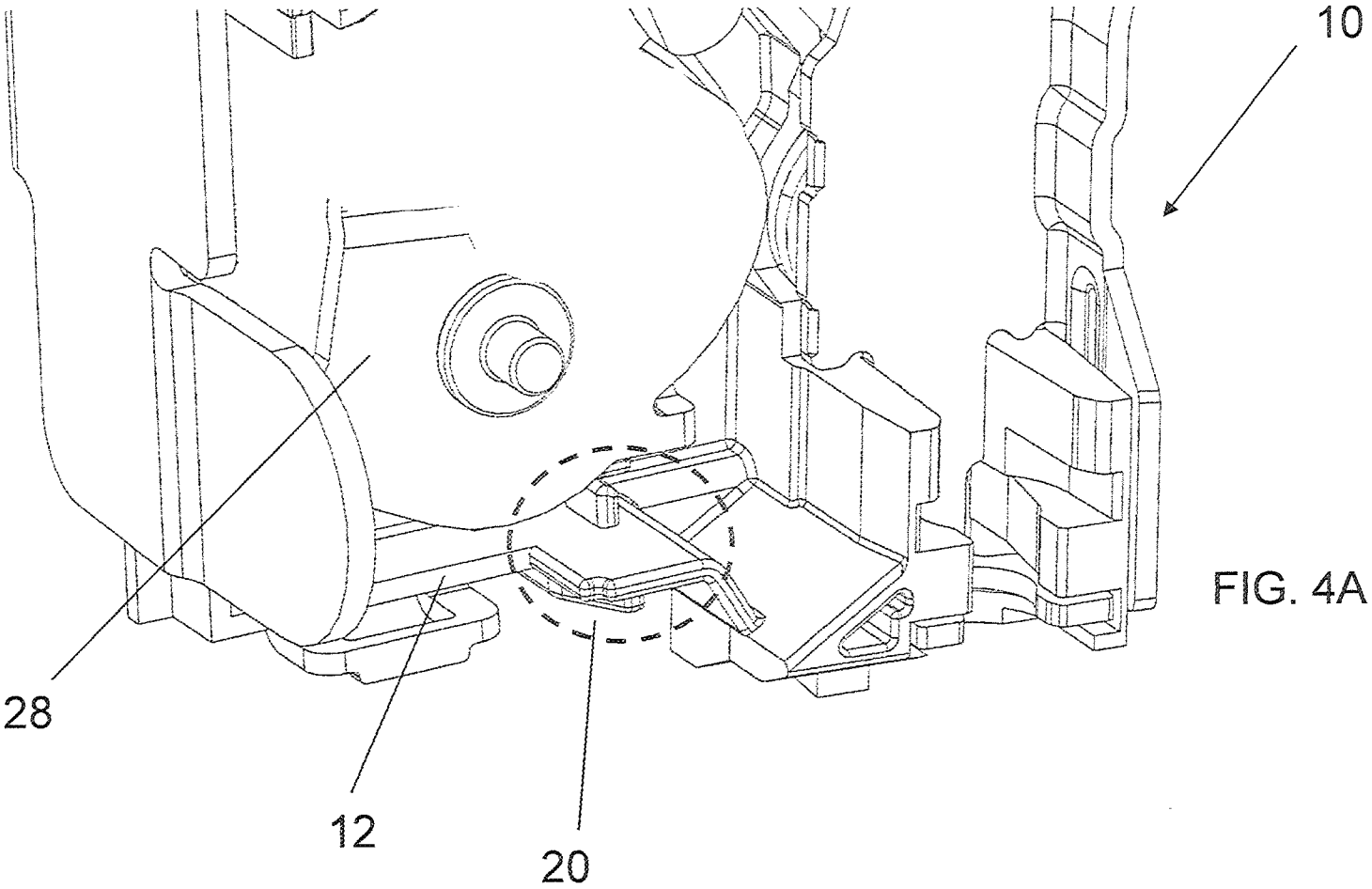
FIG. 4A is an enlarged front perspective view of a housing without a drain opening in accordance with an embodiment of the present invention.
Figure 4B:
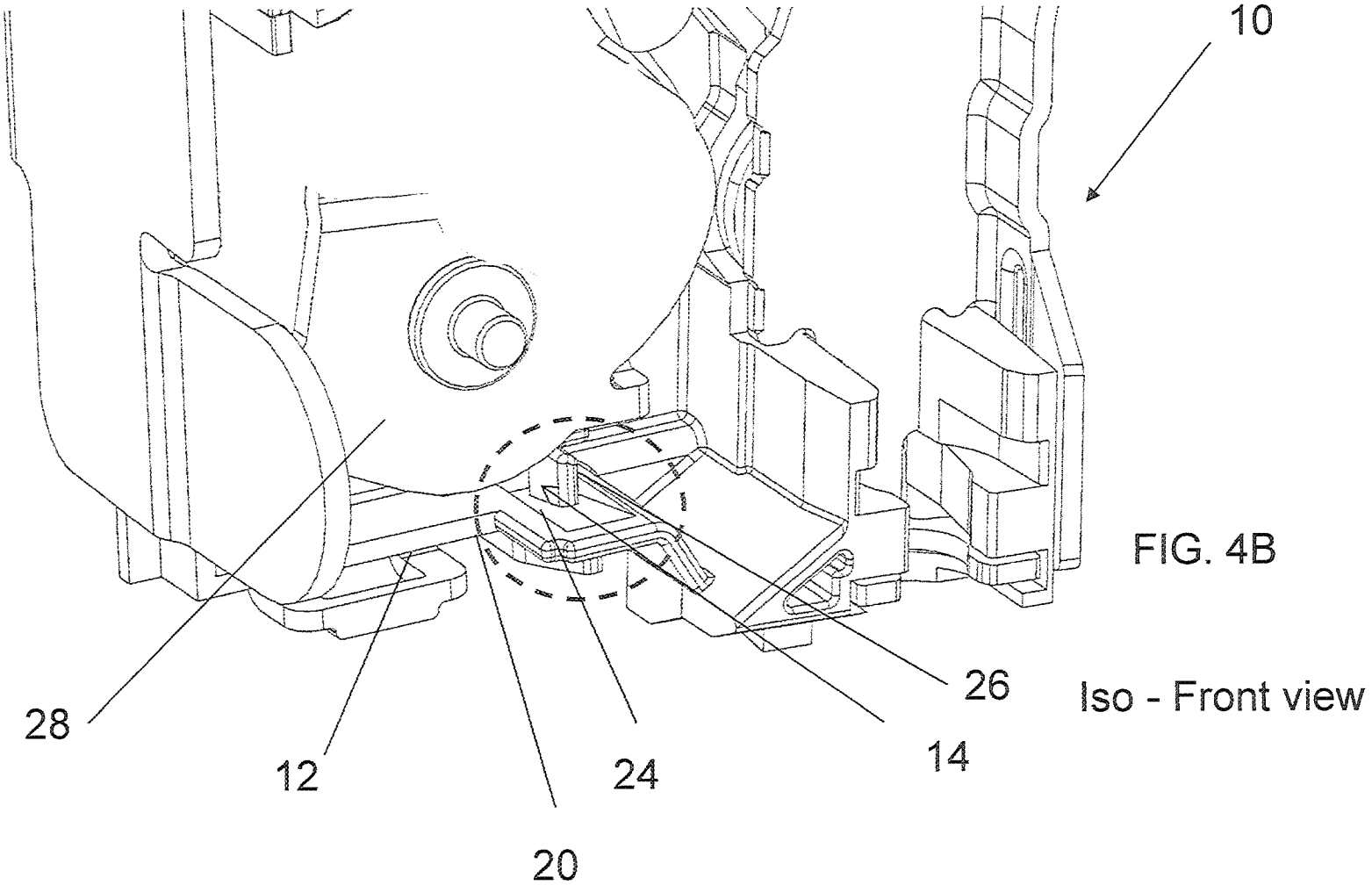
FIG. 4B is an enlarged front perspective view of a housing with a drain opening in accordance with an embodiment of the present invention.
Figure 5A:
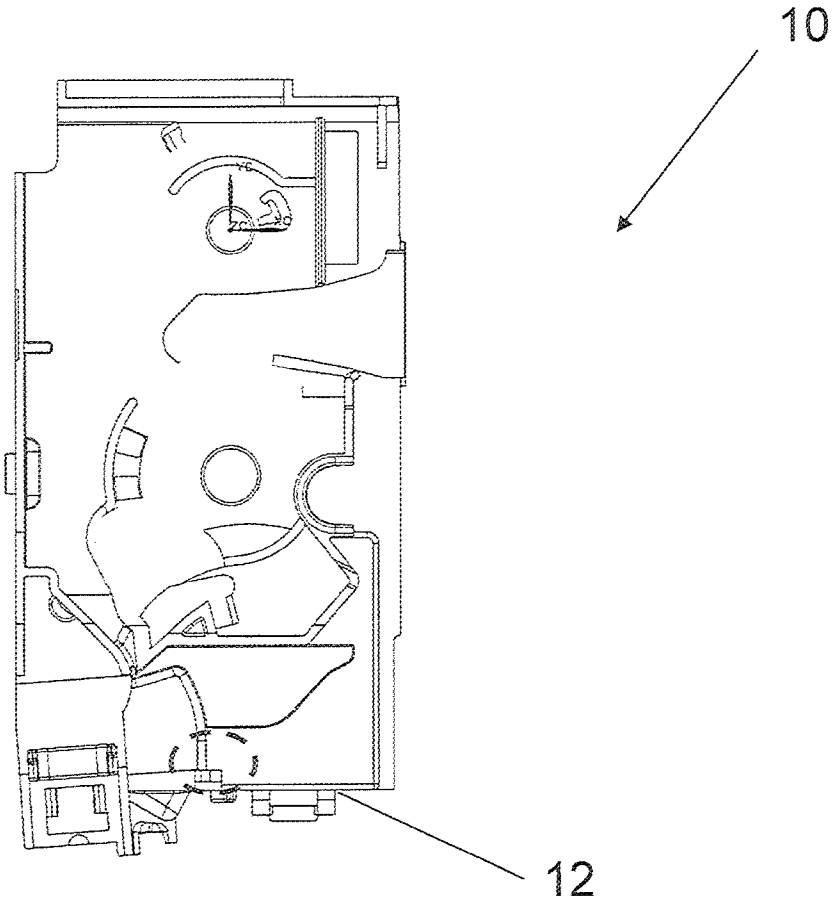
FIG. 5A is a back view of the housing of FIGS. 1 and 2 without a drain opening in accordance with an embodiment of the present invention.
Figure 6A:
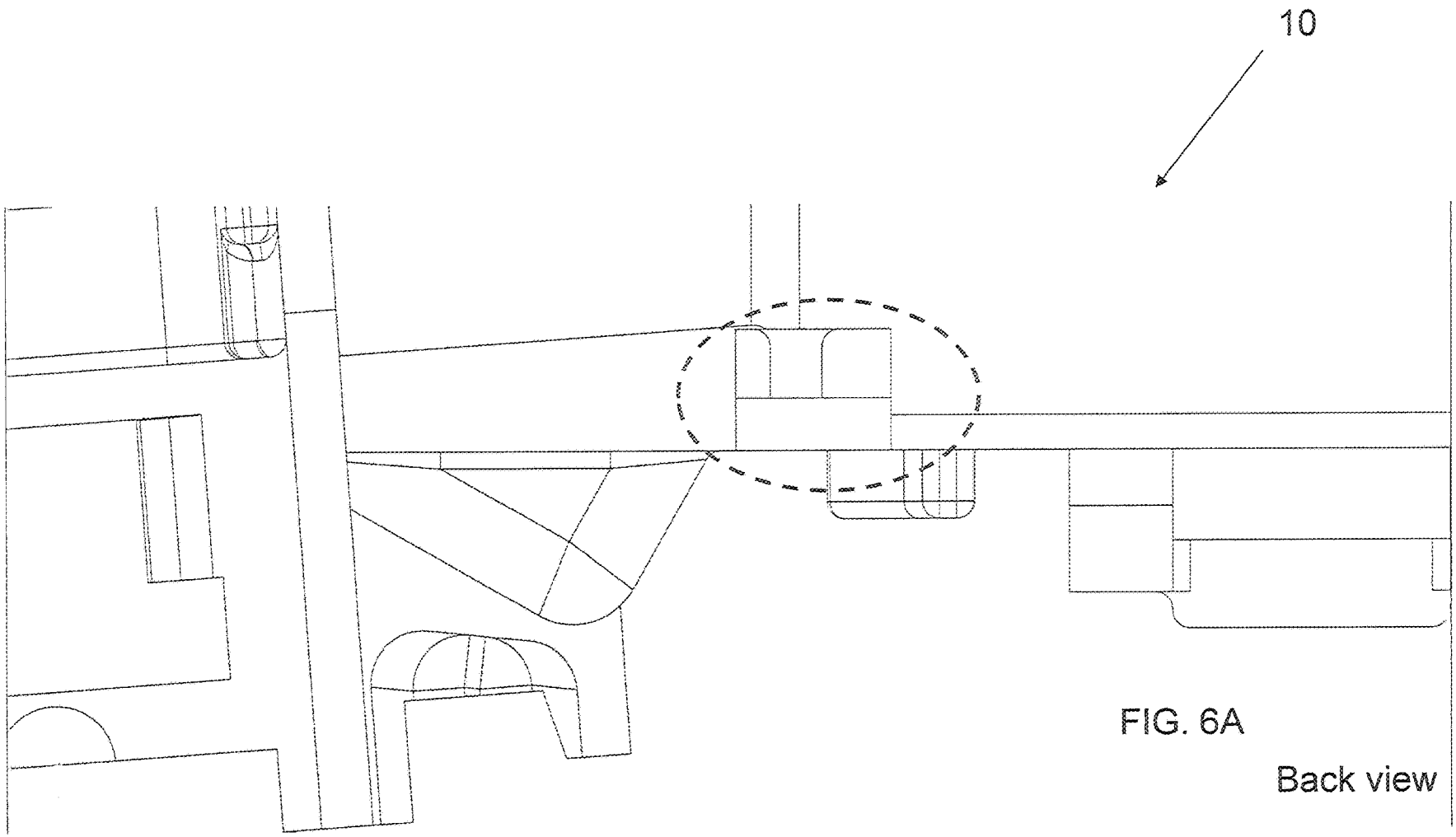
FIG. 6A is an enlarged rear view of a housing without a drain opening in accordance with an embodiment of the present invention.
Figure 6B:
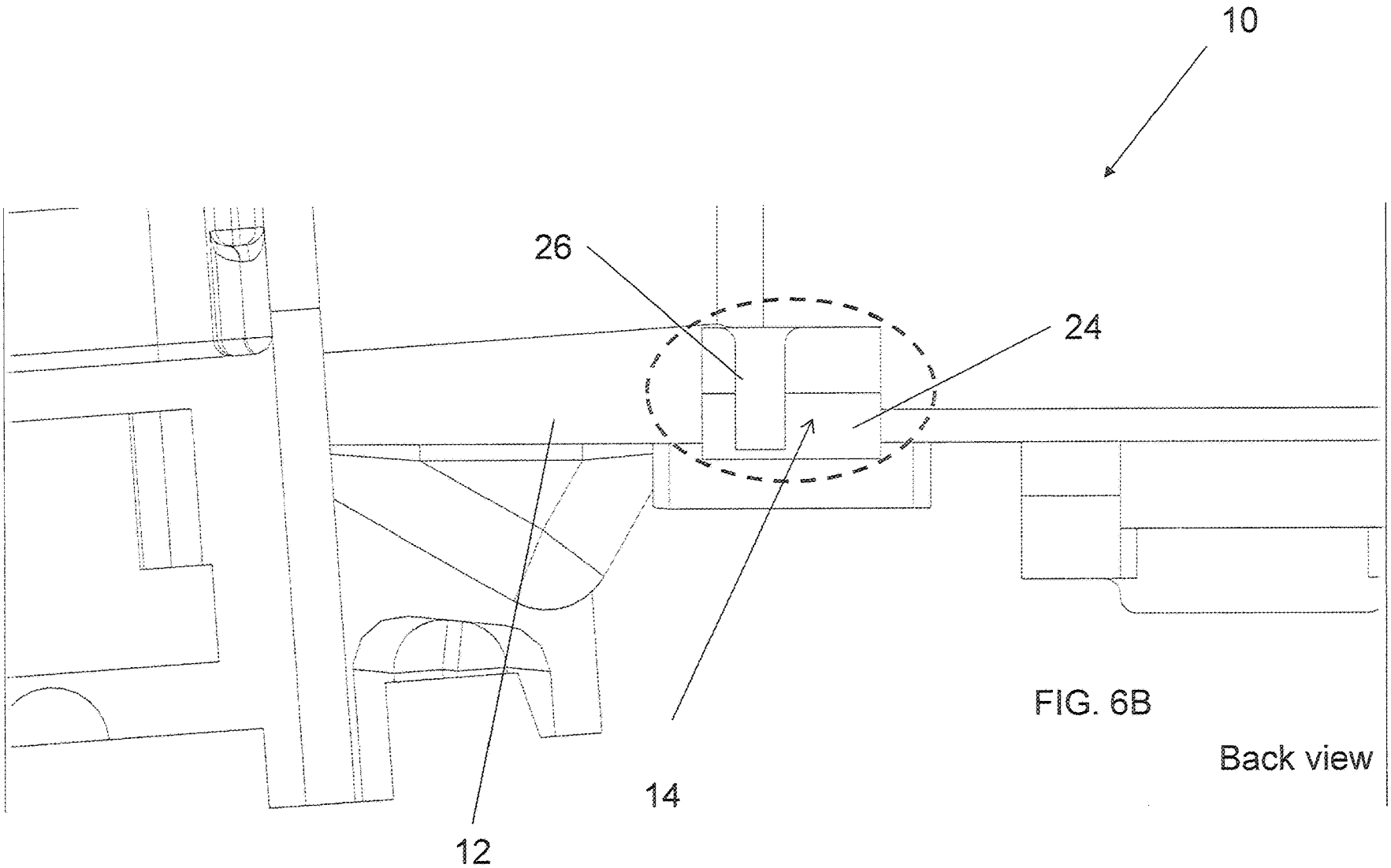
FIG. 6B is an enlarged rear view of a housing with a drain opening in accordance with an embodiment of the present invention.
Figure 7A:
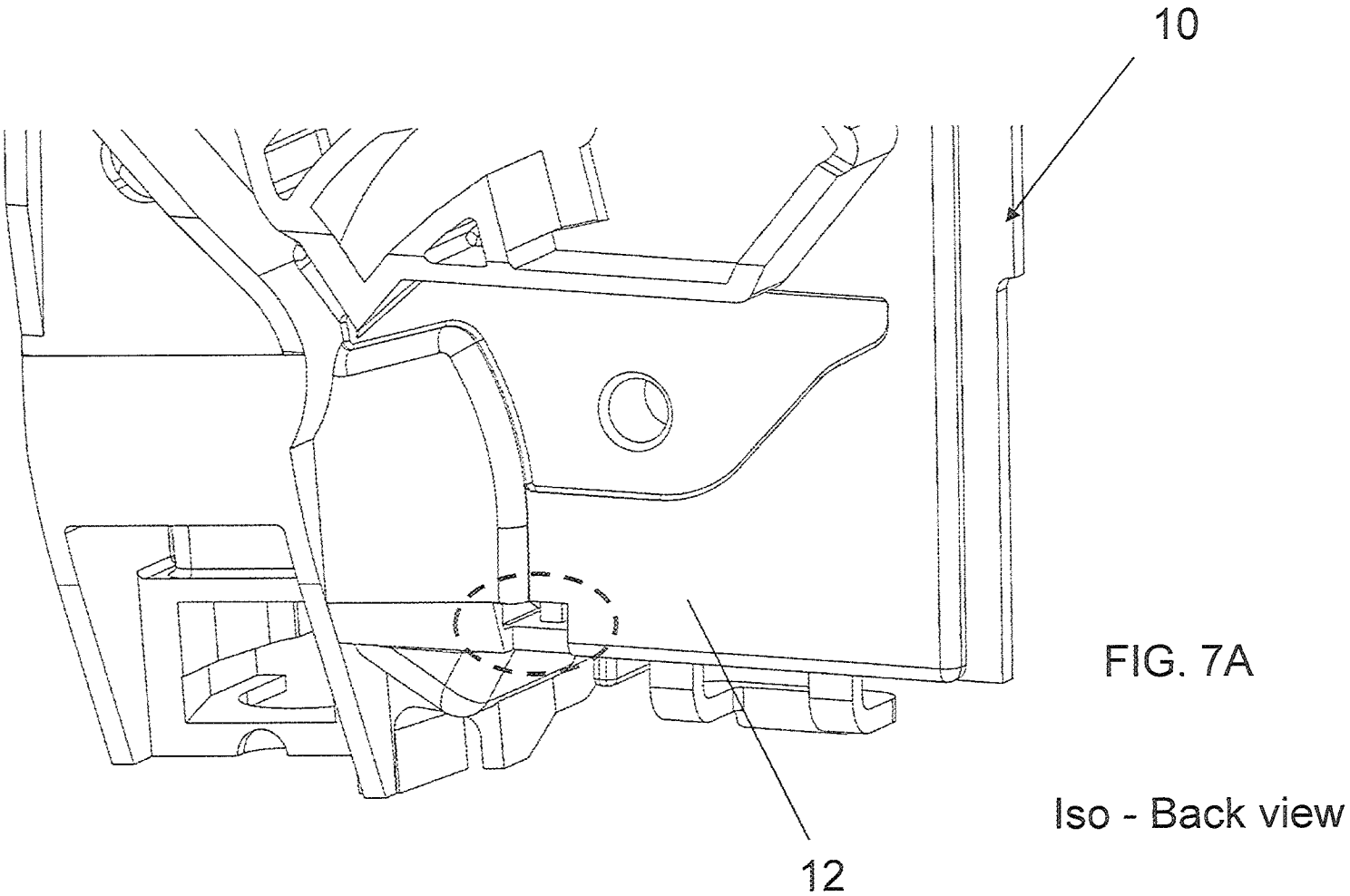
FIG. 7A is a rear perspective view of a housing without a drain opening in accordance with an embodiment of the present invention.
Figure 7B:
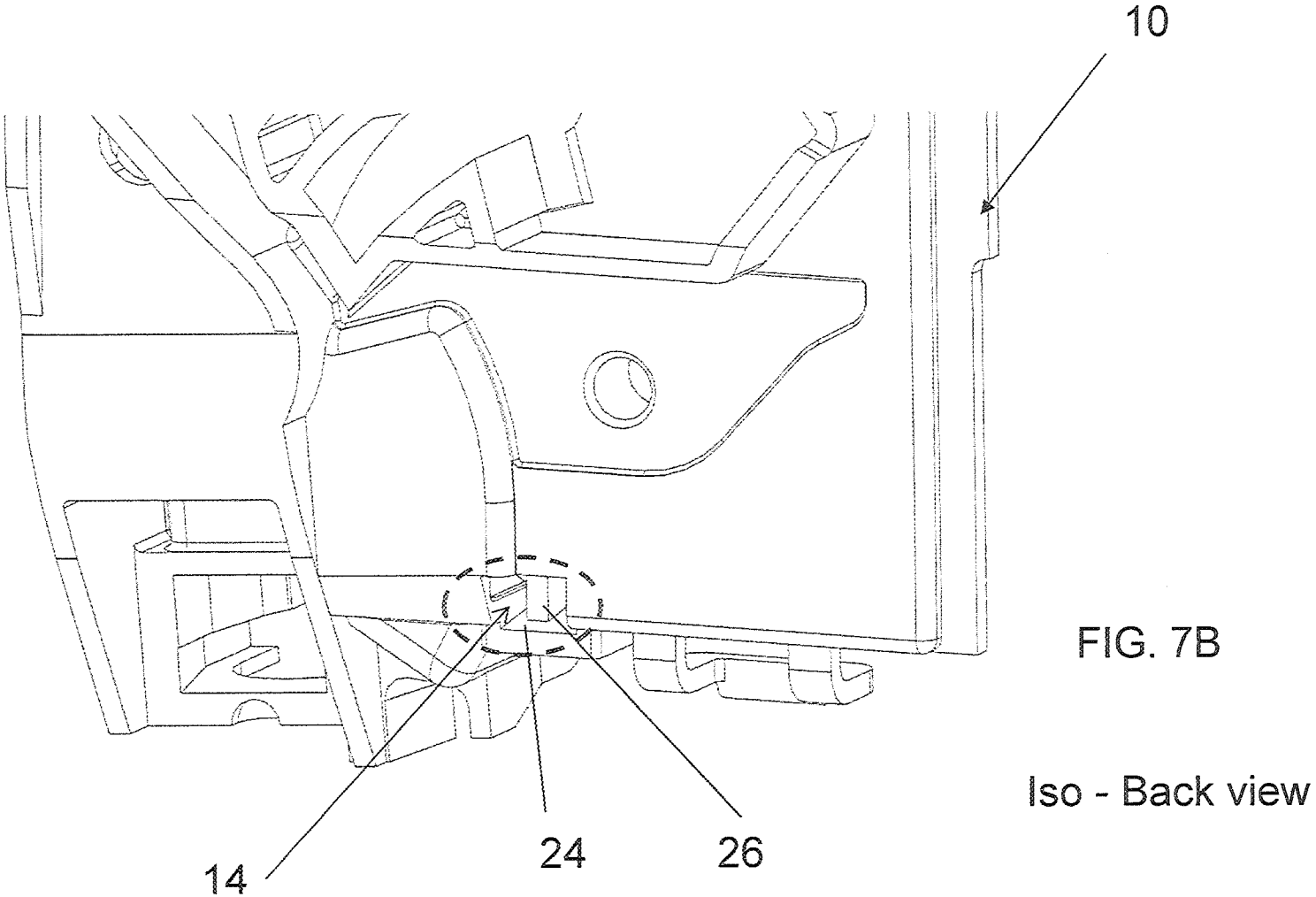
FIG. 7B is a rear perspective view of a housing with a drain opening in accordance with an embodiment of the present invention.
Figure 8A:
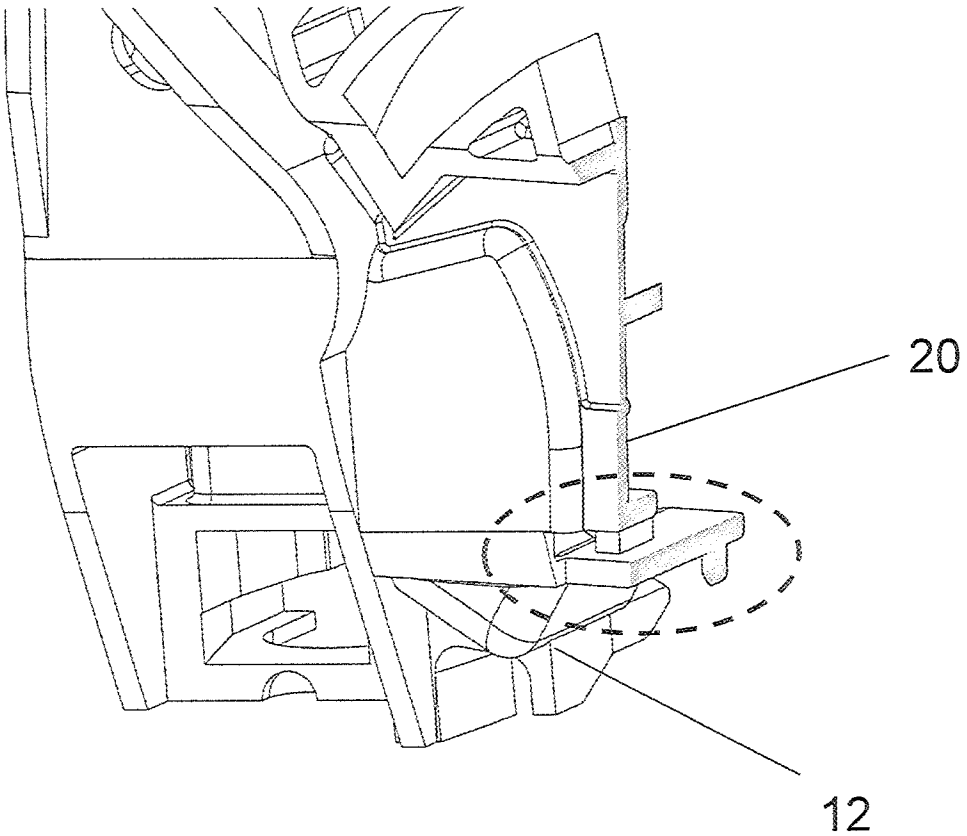
FIG. 8A is a cross sectional rear perspective view of a housing without a drain opening in accordance with an embodiment of the present invention.
Figure 8B:
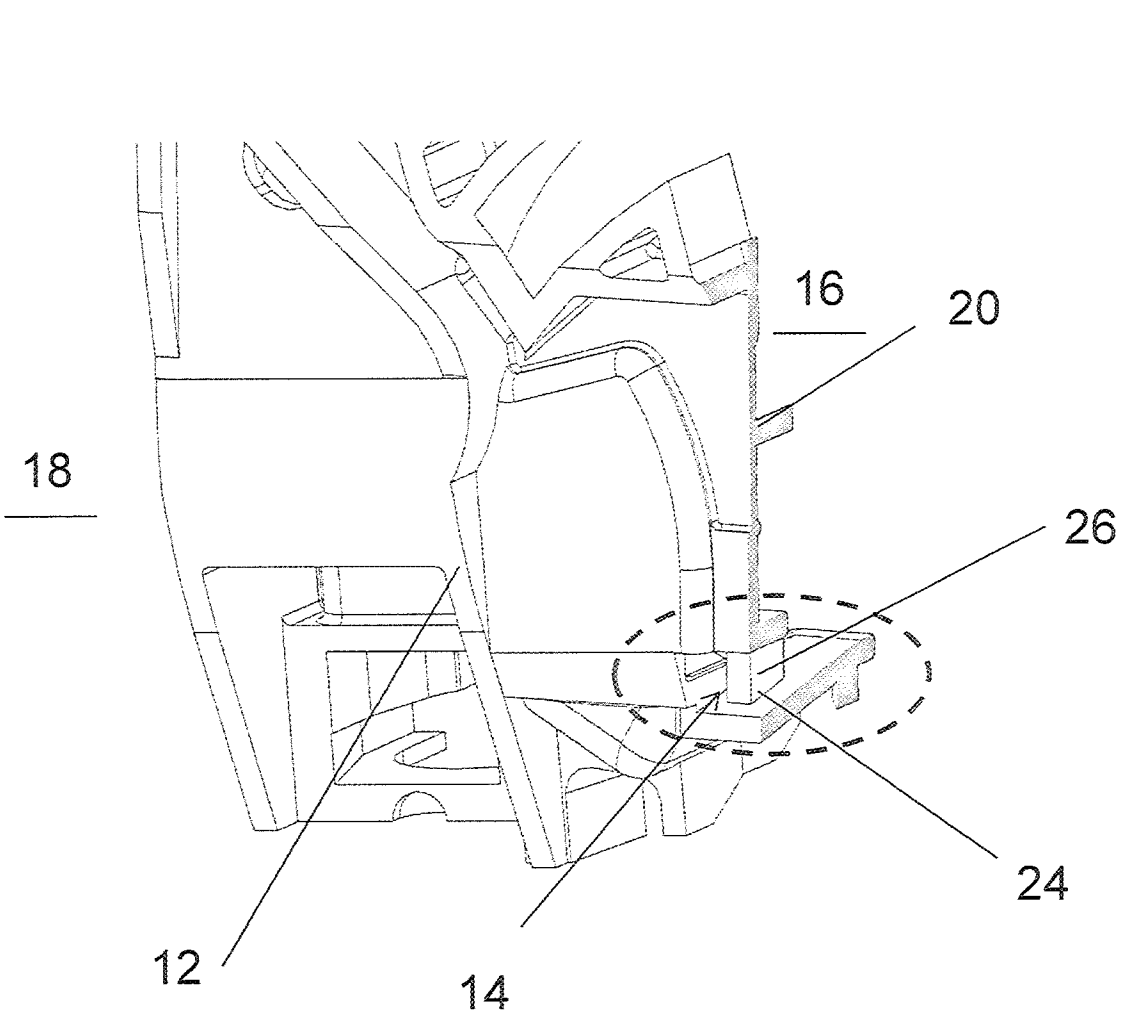
FIG. 8B is a cross sectional rear perspective view of a housing with a drain opening in accordance with an embodiment of the present invention.
Figure 9A:
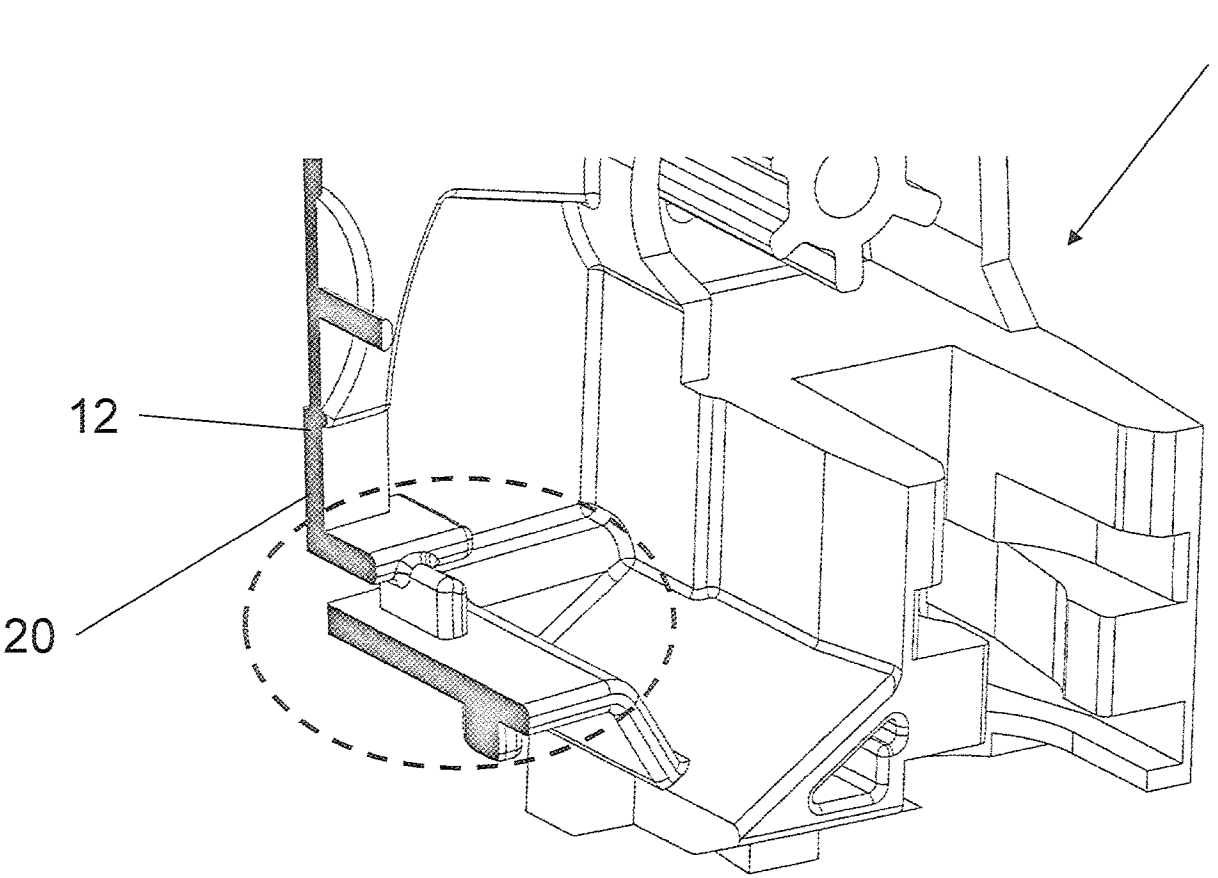
FIG. 9A is a cross sectional front perspective view of a housing without a drain opening in accordance with an embodiment of the present invention.
Figure 9B:
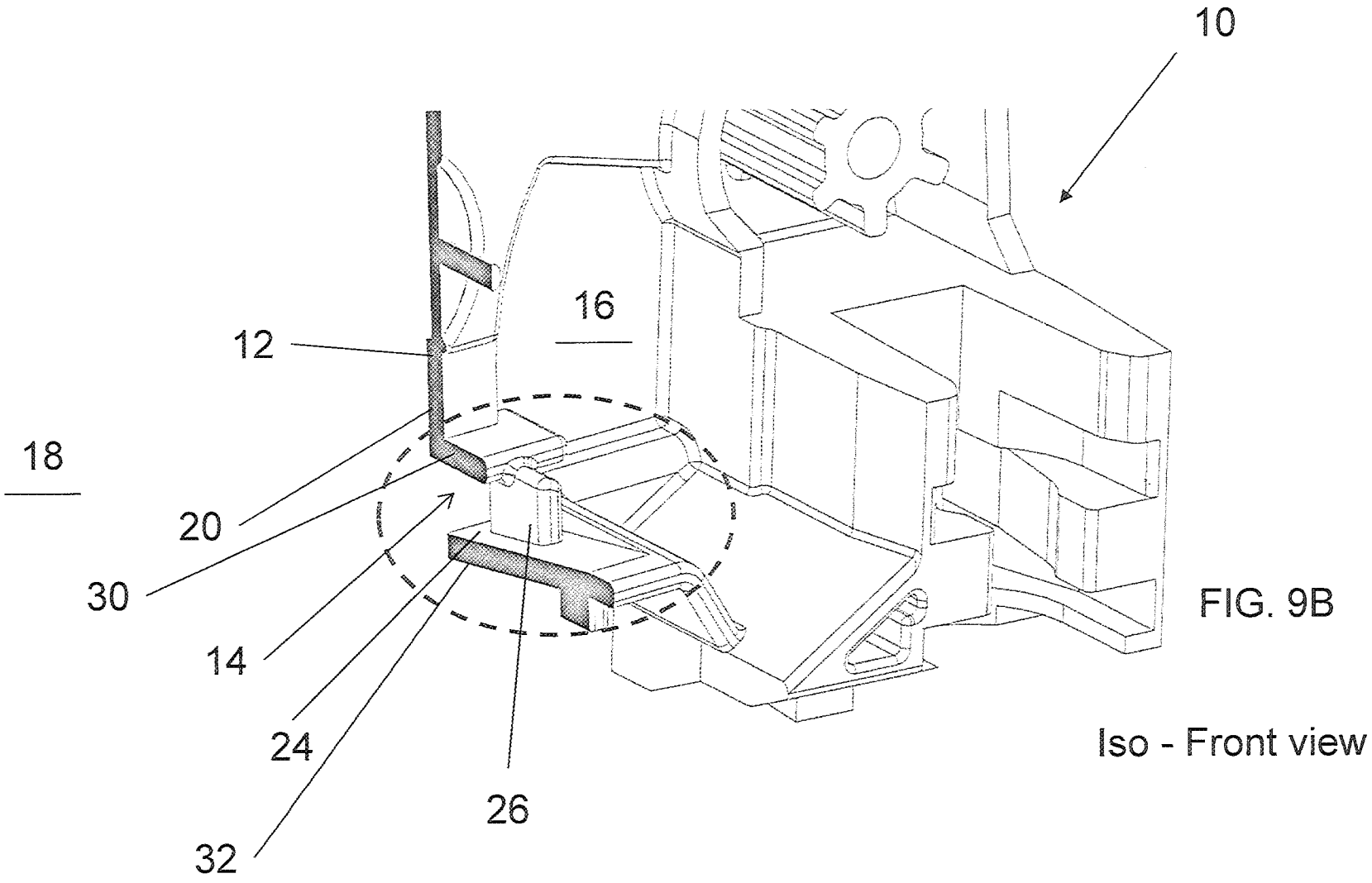
FIG. 9B is a cross sectional front perspective view of a housing with a drain opening in accordance with an embodiment of the present invention.
Figure 11:
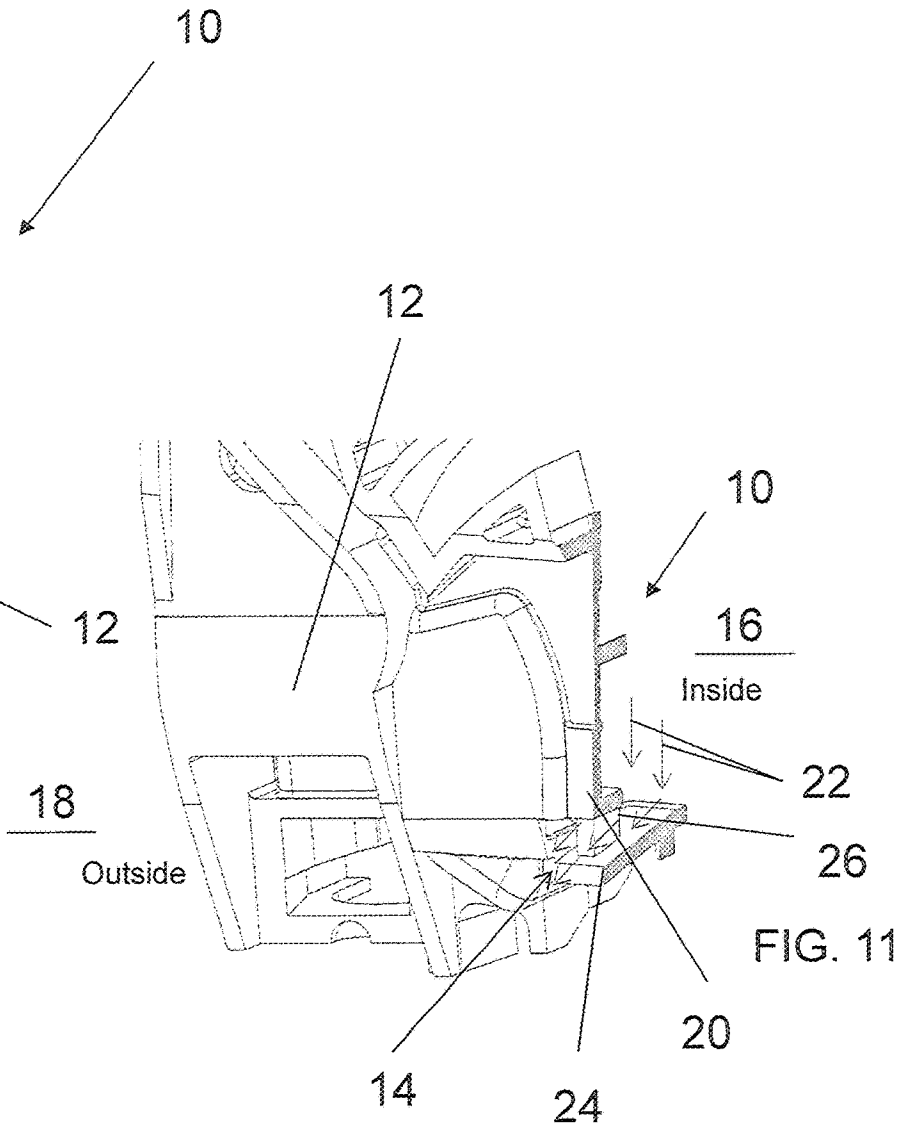
FIG. 11 is a cross sectional perspective view of a housing with a drain opening in accordance with an embodiment of the present invention.
Figure 10:
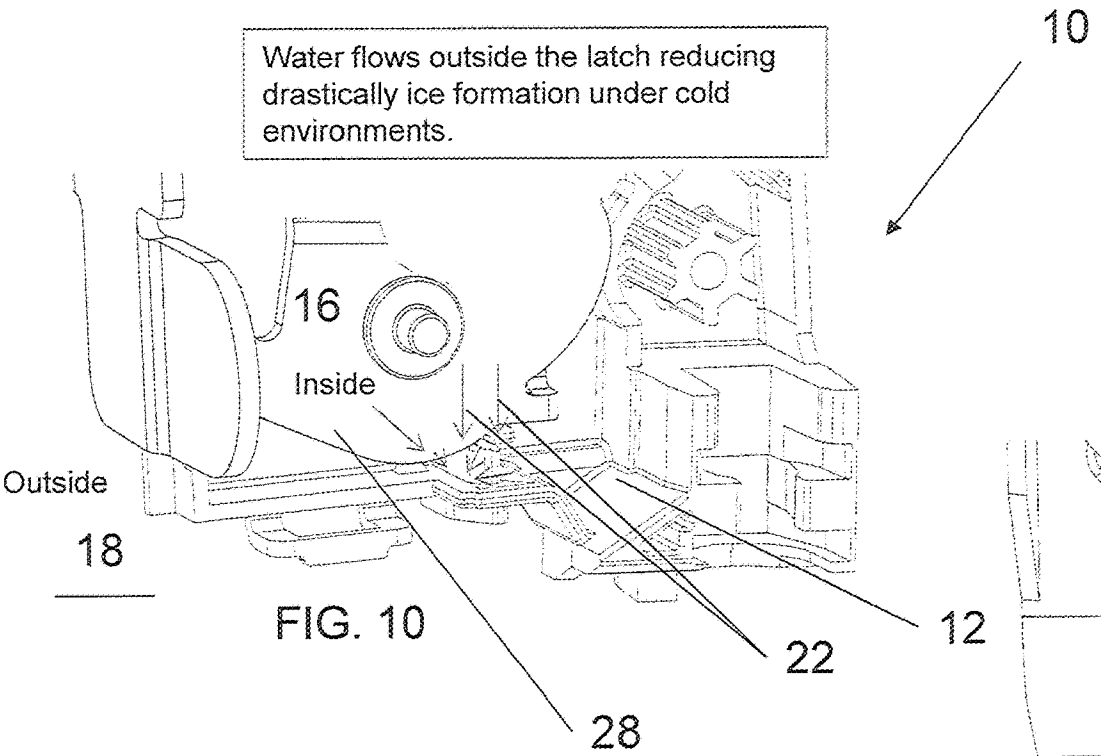
FIG. 10 is a perspective view of the latch housing with a drain opening in accordance with an embodiment of the present invention
Figure 12:
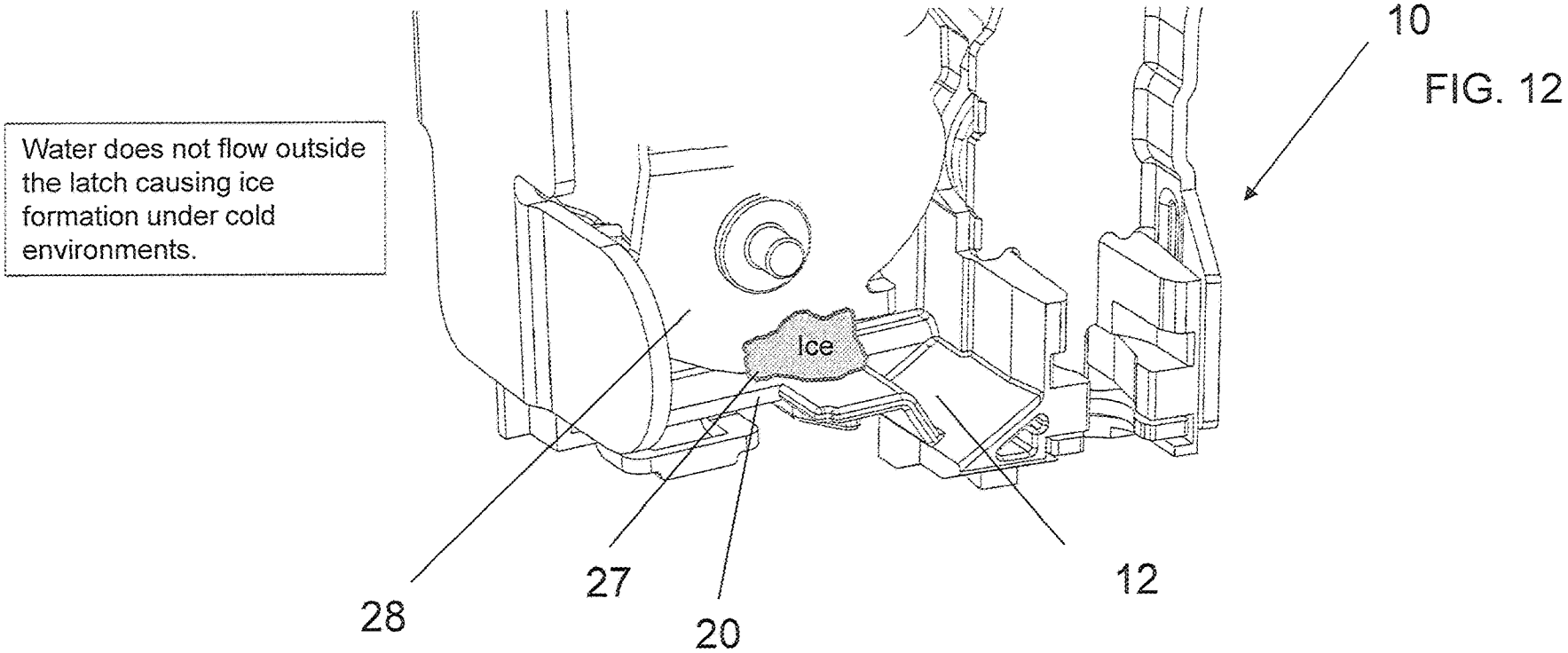
FIG. 12 is a perspective view of the latch housing without a drain opening in accordance with an embodiment of the present invention.

FIGS. 1, 2, 4A, 5A, 6A, 7A, 8A, 9A and 12 illustrate a latch or latch assembly or portions thereof without a drain opening in accordance with an exemplary embodiment of the present invention while FIGS. 3, 4B, 5B, 6B, 7B, 8B, 9B, 10 and 11 illustrate a latch or latch assembly or portions thereof with a drain opening in accordance with an exemplary embodiment of the present invention.

In one embodiment, the latch or latch assembly has a housing or latch housing 12 that has a liquid fluid pathway or water pathway 14 extending from an interior 16 of the housing 12 to an exterior 18 of the housing 12. In one implementation the opening, or fluid pathway or liquid pathway 14 extends through a perimeter wall 20, wherein the fluid pathway is formed such that water or fluid flow from the interior 16 of the housing 12 to the exterior 18 is allowed or unimpeded in a first direction represented by arrows 22.

In one embodiment, the perimeter wall 20 may be located proximate to the outer periphery of the housing 12. In one non-limiting embodiment, the housing 12 of the latch or latch assembly 10 is formed from an easily moldable material such as plastic.

In accordance with an exemplary embodiment of the present invention, the opening or fluid pathway 14 has an inclined or downwardly sloping surface 24 so that gravity can pull fluids from the interior 16 of the latch or latch assembly 10 towards the exterior 18 of the latch or latch assembly 10. It being understood that the configurations illustrated in the attached FIGS. represent the installed configuration of the latch or latch assembly 10 so that water and fluids will be drawn from the interior 16 of the latch or latch assembly 10 to the exterior 18 of the latch or latch assembly 10. Also, the drain path and/or sloping surface 24 are designed in such a way to prevent against direct air flow into the housing and, therefore, avoid dust intrusion into latch assembly 10.

The opening 14 of the latch or latch assembly 10 also includes a wall member 26 that extends from the inclined surface and is positioned in order to prevent unauthorized access into the interior 16 of the latch or latch assembly 10 in an attempt to manipulate the latch or latch assembly 10 with a tool or other device capable of being inserted into the latch or latch assembly 10. In other words, the wall member 26, which is functionally considered a guard wall member, is configured to prevent unauthorized operation of the latch or latch assembly 10 while still allowing fluids to drain from the interior 18 of the latch or latch assembly 10 to the exterior of the latch or latch assembly 10.

The inclined or ramped surface 24 prevents accumulation of fluids in the interior of the housing 12, which may freeze if the temperatures the latch or latch assembly 10 is exposed to is less than the freezing point of the accumulated fluids. For example, frozen fluids or ice is illustrated as item 27 in FIG. 12. If the fluids freeze they may interfere or prohibit operational movement of movably component(s) 28 of the latch or latch assembly 10. For example and in one implementation, the movable component 28 is a release lever of the latch 10. Of course, other movable components of latch 10 are considered to be within the scope of various embodiments of the present invention. Accordingly and by including, the inclined or ramped surface 24 into the housing 12 of the latch or latch assembly 10 fluids are able to be drawn by gravity from the interior 16 of the latch or latch assembly 10 to the exterior 18 of the latch or latch assembly 10. As such, one of the intended benefits is to prevent the accumulation of fluids that may freeze within the interior 16 of the housing of the latch or latch assembly 10.

Accordingly an improvement over current latch housing designs is provided. Prior latch housing designs do not allow water to flow out of the latch assembly, causing water to accumulate in the bottom of housing and freeze when exposed to cold environments (temperatures below water freezing point); ice formation may not allow proper function of a release lever or other components of the latch, which will prevent the door latch from being able to open via inside and outside release handles.

Various embodiments of the present invention provide a new feature that includes a water drain hole with an angled bottom wall that avoids water accumulation, and still protects the latch assembly against theft (antitheft feature) by two walls (30 and 32) that prevent an external object from being introduced to the latch to get it to open (unlatch).

Also, the drain path is designed in such a way to prevent against direct air flow and, therefore, avoid dust intrusion into latch assembly.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A housing for a vehicle latch, the housing having an interior, the interior suitable for encasing components of a latch assembly, the housing has a fluid pathway extending from the interior of the housing to an exterior of the housing through a perimeter wall of the housing, the fluid pathway being defined by an inclined surface that extends downwardly and away from the interior of the housing to an exterior of the housing, a guard wall member located in the fluid pathway and dividing the fluid pathway into at least two separate flow paths, wherein the guard wall member is positioned and configured to prevent unauthorized operation of the latch assembly while still allowing fluids to drain from the interior.

2. The housing as in claim 1, wherein the housing is formed from plastic.

3. The housing as claim 1, wherein the guard wall member extends vertically from the inclined surface.

4. The housing as in claim 3, wherein the housing is formed from plastic.

5. The housing as in claim 1, wherein an opening of the fluid pathway is located proximate to a movable component of the latch located within the housing.

6. The housing as claim 5, wherein the guard wall member extends vertically from the inclined surface.

7. The housing as in claim 6, wherein the housing is formed from plastic.

8. A vehicle latch, the vehicle latch comprising:

a housing, the housing having an interior, the interior suitable for encasing components of a latch assembly;

a fluid pathway extending from the interior of the housing to an exterior of the housing, the fluid pathway extending through a perimeter wall of the housing, the fluid pathway being defined by an inclined surface that extends downwardly and away from the interior of the housing to the exterior of the housing when the latch is in an installed configuration, and a guard wall member located in the fluid pathway and dividing the fluid pathway into at least two separate flow paths, wherein the guard wall member is positioned and configured to prevent unauthorized operation of the latch assembly while still allowing fluids to drain from the interior.

9. The latch as in claim 8, wherein the housing is formed from plastic.

10. The latch as claim 8, wherein the guard wall member extends vertically from the inclined surface.

11. The latch as in claim 10, wherein the housing is formed from plastic.

12. The latch as in claim 8, wherein an opening of the fluid pathway is located proximate to a movable component of the latch located within the housing.

13. The latch as claim 12, wherein the guard wall member extends vertically from the inclined surface.

14. The latch as in claim 13, wherein the housing is formed from plastic.

15. A method of draining fluids from an interior of a vehicle latch, the method comprising:

providing a housing for the vehicle latch, the housing having an interior, the interior suitable for encasing components of a latch assembly;

configuring the housing such that when there is fluid in or near the interior of a housing, gravity pulls the fluid downwardly so that the fluid can flow in a manner locating a fluid pathway in the housing of the vehicle latch, wherein the fluid pathway extends from the interior of the housing to an exterior of the housing, the fluid pathway extends through a perimeter wall of the housing, the fluid pathway being defined by an inclined surface that extends downwardly and away from the interior of the housing to the exterior of the housing when the latch is in an installed configuration;

configuring the fluid pathway such that the fluid continues to flow in a manner locating a guard wall member in the fluid pathway; the guard wall member dividing the fluid pathway into at least two separate flow paths;

wherein the guard wall member is positioned and configured to prevent unauthorized operation of the latch assembly while still allowing fluids to drain from the interior.

16. The method as in claim 15, wherein the housing is formed from plastic.

17. The method as claim 15, wherein the guard wall member extends vertically from the inclined surface.

18. The method as in claim 17, wherein the housing is formed from plastic.

19. The method as in claim 15, wherein an opening of the fluid pathway is located proximate to a movable component of the latch located within the housing.

20. The method as claim 19, wherein the guard wall member extends vertically from the inclined surface.

* * * * *